US008727406B2

(12) United States Patent
Dohse et al.

(10) Patent No.: US 8,727,406 B2
(45) Date of Patent: May 20, 2014

(54) ROUND SLING FOR LIFTING LOADS

(75) Inventors: Lars Dohse, Aachen (DE); Werner Glasen, Herzogenrath (DE)

(73) Assignee: Spanset Inter AG, Wollerau (CH)

( * ) Notice: Subject to any disclaimer, the term of this patent is extended or adjusted under 35 U.S.C. 154(b) by 0 days.

(21) Appl. No.: 13/141,220

(22) PCT Filed: Feb. 18, 2010

(86) PCT No.: PCT/EP2010/052061
§ 371 (c)(1),
(2), (4) Date: Aug. 24, 2011

(87) PCT Pub. No.: WO2010/097328
PCT Pub. Date: Sep. 2, 2010

(65) Prior Publication Data

US 2011/0298231 A1 Dec. 8, 2011

(30) Foreign Application Priority Data

Feb. 27, 2009 (DE) ..... 10 2009 010 680

(51) Int. Cl.
*B66C 1/12* (2006.01)

(52) U.S. Cl.
USPC ..... 294/74

(58) Field of Classification Search
USPC ..... 294/74; 57/21, 201; 87/6, 9
See application file for complete search history.

(56) References Cited

U.S. PATENT DOCUMENTS

| | | | | | |
|---|---|---|---|---|---|
| 3,707,021 | A * | 12/1972 | Norrman | 24/16 R |
| 4,354,704 | A * | 10/1982 | Mayerjak | 294/74 |
| 4,789,045 | A * | 12/1988 | Pugh | 182/190 |
| 4,843,807 | A * | 7/1989 | von Danwitz | 57/201 |
| 4,850,629 | A * | 7/1989 | St. Germain | 294/74 |
| 5,727,833 | A * | 3/1998 | Coe | 294/74 |
| 6,422,624 | B1 * | 7/2002 | Kauffman et al. | 294/74 |
| 7,240,475 | B2 * | 7/2007 | Smeets et al. | 57/201 |
| 7,628,435 | B1 * | 12/2009 | Golz | 294/74 |
| 7,658,351 | B2 * | 2/2010 | Hansen | 248/74.3 |
| 7,658,423 | B1 * | 2/2010 | Carmichael | 294/74 |
| 2004/0255568 | A1 | 12/2004 | Shih | |

FOREIGN PATENT DOCUMENTS

| | | | |
|---|---|---|---|
| DE | 3703547 | A1 | 8/1988 |
| DE | 202007001484 | U1 | 3/2007 |
| DE | 102006052279 | A1 | 5/2008 |
| EP | 0281287 | A1 | 9/1988 |
| WO | 2008044855 | A1 | 4/2008 |

* cited by examiner

*Primary Examiner* — Stephen Vu
(74) *Attorney, Agent, or Firm* — The Webb Law Firm

(57) ABSTRACT

A roundsling for lifting loads includes an inner non-interwoven structure and a covering which receives the inner non-interwoven structure, the covering taking the form of a hollow braided structure and its end portions being inserted in one another and being connected together to overlap one another in a connection zone. In a roundsling of this kind, there is formed, in that end portion which is on the outside in the connection zone, at least one lateral opening which leads to the circumferential surface of the end portion, and that there is held, in that end portion which is on the inside in the connection zone, a securing member which is passed through the opening in that end portion which is on the outside.

13 Claims, 3 Drawing Sheets

ROUND SLING FOR LIFTING LOADS

BACKGROUND OF THE INVENTION

1. Field of the Invention

The invention relates to a roundsling which has an inner non-interwoven structure and a covering which receives the inner non-interwoven structure, the covering taking the form of a hollow braided structure and its end portions being inserted in one another and being connected together to overlap one another in a connection zone.

Roundslings of this kind are used to lift loads. For this purpose, the roundsling is first placed around the load to be lifted in such a way that the load rests in the opening in the sling, and the roundsling then hooked onto the hook of a crane or a comparable piece of lifting equipment.

A roundsling usually consists of a wound loop of yarn (the inner non-interwoven structure) which carries the load, which is covered by a protective covering comprising a braided structure. The inner non-interwoven structure may equally well be formed by a wound loop of wire rope or stranded cable.

The protective covering of the roundsling protects the non-interwoven structure against damage caused by wear or cutting loads and also groups the many strands of the inner non-interwoven structure together into a single easily handable strand.

2. Description of the Related Art

There are various possible ways in which conventional roundslings can be manufactured. One method of manufacture which has become widely used in practice is described in, for example, DE 37 03 547 A1 and in this method a woven tube is produced beforehand and is positioned on a roundsling machine when upset in its longitudinal direction.

In the winding which follows, the individual loops of yarn forming the inner non-interwoven structure are threaded into the tube until the inner non-interwoven structure reaches an adequate thickness. The sling which is obtained in this way is taken out of the machine and the ends of the tube are sewn firmly together. This is followed by the finishing.

A prerequisite for manufacture in the manner explained above is a high ratio between the cross-sections of the non-interwoven structure and the covering. This is the only way in which the covering can be upset and the wound loop forming the inner non-interwoven structure produced with the requisite reliability. A consequence which the necessarily large cross-section of the covering has is that the finished roundsling has a relatively flat cross-sectional shape and the inner non-interwoven structure is held relatively loosely in the covering.

It is true that the clear cross-section of the covering can be reduced at a later stage, and the inner non-interwoven structure can be held more tightly in the covering, by sewing in a ridge-like pleat which is left in place at the side. However, it is still unavoidable that the known roundsling will be of a flat shape. This results in considerable disadvantages in practical use.

Because the roundsling necessarily follows radiuses at the surfaces which rest against it, the woven structure of the flat covering inevitably forms creases at the bottom end of the roundsling which is associated with the load. These creases cause increased wear because the covering is subject to a greater chafing load in the region of the creases than in the region of the remainder of its outside surface. The creasing also leads to a reduction in the maximum tensile strength of the roundsling, because the thickenings which occur interfere with the transmission of the load in the inner non-interwoven structure which carries the load. A complicating factor in this case is that the individual yarns of the inner non-interwoven structure, which latter rests relatively loosely in the protective covering, are able to move relative to one another and as a result the yarns of the non-interwoven structure are not, as a whole, evenly loaded. Also, the loose make-up of the roundsling and the generous dimensions of the covering when compared with the diameter which the inner non-interwoven structure assumes make handling more difficult as a result of what could be said to be the excess amount of covering material, because the sling is floppy or slack and as such is for example difficult to fit over a hook or a comparable projection.

Improved properties in use and a longer life due to an appreciably reduced proneness to wear are exhibited by roundslings whose covering takes the form of a hollow braided structure. A roundsling of this kind is described in DE 10 2006 052 279 A1 for example.

In roundslings of this kind, use is made of the possibility which is known per se from the field of conventional core-and-sheath cables of surrounding an interior yarn core with a braided covering. The hollow braided structure can be braided directly around the inner non-interwoven structure in this case. Alternatively, it may be produced beforehand to then be filled with the inner non-interwoven structure.

In the latter case, a hollow braided structure has the advantage that it can be upset with an accompanying enlargement of its clear cross-section and becomes narrower again when it is then pulled straight. The upsetting involves, at the same time, a shortening of the length of the hollow braided covering. In exactly the same way, stretching out of the hollow braided structure results not only in a reduction in the diameter of the covering but also in a lengthening of the actively effective length of the covering.

Basically, it is possible for the ends of a pre-produced hollow braided covering to be connected together in any suitable manner in such a way that any unintentional disconnection of the covering is reliably prevented and that there is assured protection for the inner non-interwoven structure at all times in use. For this purpose, the ends of the covering may for example be adhesive-bonded, welded or sewn together.

However, it practice it has been found that there are disadvantages to every one of these possible methods of connection. In this way, adhesive-bonded or welded connections are found to be a problem if the covering has to carry certain tensile loads while items are being moved. In this case the adhesive-bonded or welded connection is subject to adverse shear forces which may result in the connection peeling apart or tearing. The sewing together of the ends of a hollow braided covering has the disadvantage that the covering, which rests tightly against the inner non-interwoven structure, cannot easily be sewn together with conventional sewing machines in such a way that the seams will withstand even high loads. Added to this is the fact that the sewing together of the covering can often only be performed in such a way that the inner non-interwoven structure is pierced by the yarn which makes the seam. This may result in the individual strands of the non-interwoven structure no longer being able to align themselves in the optimum way under load, which may cause premature fracture particularly in the case of fibres which, although they may have a high carrying capacity, are at the same time only able to stretch to a small extent.

DE 20 2007 001 484 U1 shows a cable sling comprising a hollow braided structure which is braided without a core, the ends of this cable being connected together by splicing, for which purpose openings are provided in the ends of the cable.

SUMMARY OF THE INVENTION

Against this background, the object of the invention was to provide a roundsling which would enable the advantages of a hollow braided covering to be exploited and which could, at the same time, be produced easily and inexpensively.

This object has been achieved in accordance with the invention by a roundsling.

The design of roundsling according to the invention is based on the idea of passing a securing member which is held in that end portion which is situated on the inside in the connection zone through an opening in that end portion which is situated on the outside in the connection zone, in such a way that the end portions are secured after the fashion of a positive interengaged joint against being separated by forces acting in their longitudinal direction.

For this purpose, a roundsling according to the invention has, as in the prior art, an inner non-interwoven structure and a covering which receives the inner non-interwoven structure. The covering takes the form of a hollow braided structure whose end portions are connected together in a connection zone, the end portions being so aligned that they overlap.

The invention is thus based on roundslings in which the covering is pre-produced as a hollow braided structure, is then upset, and is then filled with the wound loop forming the inner non-interwoven structure, whereupon the hollow braided covering is stretched out again and the end portions are finally connected solidly together.

In accordance with the invention, on the one hand there is then formed in a roundsling of this kind, in that end portion which is on the outside in the connection zone, at least one lateral opening which leads to the circumferential surface of the end portion. On the other hand, there is held, in that end portion which is on the inside in the connection zone, a securing member which is passed through the opening in that end portion which is on the outside. In this way, the securing member fixes the end portions relative to one another after the fashion of a positively interengaged joint in such a way that, looking in their longitudinal direction, they are able to move relative to one another at most within the limits set by the inevitable resilience of the covering or the securing member.

Surprisingly, it has been found that the coupled connection between the end portions of a hollow braided covering which is made in accordance with the invention will withstand even high tensile loads. In this way, even in the region of the opening which is present in each case, damage to the covering regularly occurs for example only at loads which are regularly more than twice the working load for which the given roundsling is approved.

Particularly high loads with, at the same time, particularly great security against tearing or comparable damage in the region of the given opening in the end portion concerned can be achieved by fixing the braided structure of the covering in place at least in that end portion which is provided with a given opening. A fixing in place of this kind which is carried out as standard is generally carried out before the non-interwoven structure is pulled into the hollow braided structure and immobilises the fibres of the braided structure relative to one another in such a way that even if they come into contact with rough or pointed surfaces there is only a very much reduced risk of loops being pulled out of the covering. Fixing in place of this kind may for example be accomplished by braiding into the covering a fibre which melts at comparatively low temperatures and bonds the fibres of the hollow braided structure together after the fashion of an adhesive.

Another possible way of performing the fixing in place is for the fibres of the hollow braided structure to be deliberately bonded together by applying an adhesive. Even where the entire braided structure is produced from fibres which melt at quite high temperatures, the desired connection between the fibres by a physical bond can be produced by the infeed of heat.

A further improvement in the secureness with which the end portions are coupled together in a manner according to the invention can be achieved by giving that end portion which is on the outside in the connection zone at least two openings which are spaced apart from one another in the circumferential direction and passing the securing member through each of these openings. If two such openings are provided, these openings may be arranged opposite one another to enable the covering to be loaded as evenly as possible even under high loads.

The securing means which is provided in accordance with the invention may in principle be any member which is suitable for being fastened to that end portion of the covering which is on the inside in the connection zone. In this way, the securing member may for example be a pin, a button or a comparable shaped body which is fastened to the relevant end portion and which projects therefrom.

However, what is particularly easy to fit is a securing member which is formed to be of the strip, tape or cable type. In this case, a tape of this kind may be so bonded, sewn, riveted or solidly connected in some other way to that end portion of the covering which is on the inside in the connection zone that one of its ends projects freely from the inner end portion and can be passed through the associated opening.

However, it is equally conceivable for the securing member to be inserted loose in the end portion. In this way, simply by being displaced, it may in each case be positioned in such a way that, on the one hand, it constitutes an optimum securing means but, on the other hand, can also be fixed in position at a point outside of the connection zone particularly easily.

However, in view of the limited deformability of a fixed braided structure an embodiment of the invention which is even easier to connect together in production is obtained if each opening which is present in a given case in that end portion which is on the outside in the connection zone has associated with it an opening in that end portion which is on the inside in the connection zone and if the securing member is passed through these pairs of mutually associated openings in the end portions at the same time. As well as the ability to be connected together easily, the particular advantage of this embodiment of the invention also lies in the fact that it allows the securing member to be so arranged that it is supported against the inner surface of the covering and against the inner non-interwoven structure, thus ensuring that the end portions of the covering are particularly securely coupled even under adverse loads.

The above arrangement is found to be particularly advantageous when the securing member is a tape, cable or comparable member. If, as in the embodiment of the invention which has already been mentioned above, respective ones of at least two openings are present in each end portion and if each opening in one end portion of the covering has associated with it an opening in the other end portion of the covering, then when this is the case the securing member can be passed through the openings without any problems, thus causing it to run out of the connection zone at both the end portions of the roundsling.

An optimum action by a securing member in the form of a tape or cable or a securing member of a comparable form is obtained in this case if the securing member is so run as to rest against the inner surface of that end portion which is on the inside in the connection zone and to lie against the inner non-interwoven structure.

In this case, the ends of the securing member which project out of the connection zone laterally may be brought together and solidly connected to one another. In this way, the position of the securing member is fixed at a point outside of the connection zone in as simple a way as could be conceived. There is no need in this case for any incursion into the connection zone by, for example, a sewing machine or an adhesive, and any risk of the mobility of the inner non-interwoven structure being hampered can thus be ruled out. Of course, it is also possible for securing members of other kinds which are suitable for the coupling together in accordance with the invention of the end portions of the covering to be fixed in position in some suitable way at a point outside of the covering if, by so doing, the advantages explained above are achieved.

In the event of a tape, cable or comparable member being used as a securing member and the end portions of the securing member being brought together at a point outside of the covering, their fixing in position can be accomplished in a particularly easy way by sewing the end portions of the securing member together. To make an ideally secure connection between the end portions of the securing member in this case, the end portions may, alternatively or in addition, also be connected together by means of a connecting member. This connecting member may for example be one or more layers of a tear-resistant film or textile material.

Another advantage of the invention is that a means of identification which carries information which clearly identifies the roundsling can be fastened to the securing member. Not only does this allow the particular roundsling to be easily assigned to a given place of storage or its time in use and technical data etc. to be determined easily, but a means of identification of this kind can also be used to track at a later stage or establish the particular place at which the roundsling has been or is being used. This can be done particularly easily if the means of identification is machine-readable. For this purpose the means of identification may for example be an active or passive transponder element.

Because the invention allows the ends of a hollow braided covering to be connected without the covering having to be taken hold of by a sewing machine for this purpose, the covering can easily be so designed that it rests firmly and tightly against the inner non-interwoven structure and hence that the covering of the finished roundsling is tightly filled with the inner non-interwoven structure.

The inner non-interwoven structure may be formed in a known way by a wound wire rope or a wound stranded cable. The inner non-interwoven structure may equally well be formed by a wound yarn. Because there are no incursions on the inner non-interwoven structure in the case of the connection according to the invention between the end portions of the covering, the inner non-interwoven structure is always able to move freely. Hence, in a roundsling according to the invention, the individual fibres of the inner non-interwoven structure in each case automatically align themselves in such a way that they carry the load which is acting on them in the given case in the optimum way. For the inner non-interwoven structure of a roundsling according to the invention, it is thus possible for use to be made without any problems even of fibres which, although they may have a particularly high carrying capacity, can only be stretched to a limited extent.

To provide the connection zone with additional protection, a protective sleeve may be provided which shields the connection zone from its surroundings. This sleeve may be so designed in this case that it encloses the securing member, the means of identification which may possibly be present, and the connecting member which is also present as an option, which means that these items too are protected from the surroundings.

The invention thus provides a roundsling which allows the advantages of a hollow braided covering to be exploited and which at the same time can be produced easily and inexpensively.

BRIEF DESCRIPTION OF THE DRAWINGS

In what follows, the invention will be explained in detail by reference to drawings which show an embodiment. In the drawings, which are schematic:

FIG. 3 is a perspective view of that end portion of the hollow braided covering which will be on the inside after the connection together, as the inner non-interwoven structure is being pulled in.

DETAILED DESCRIPTION OF THE INVENTION

Figure 1:
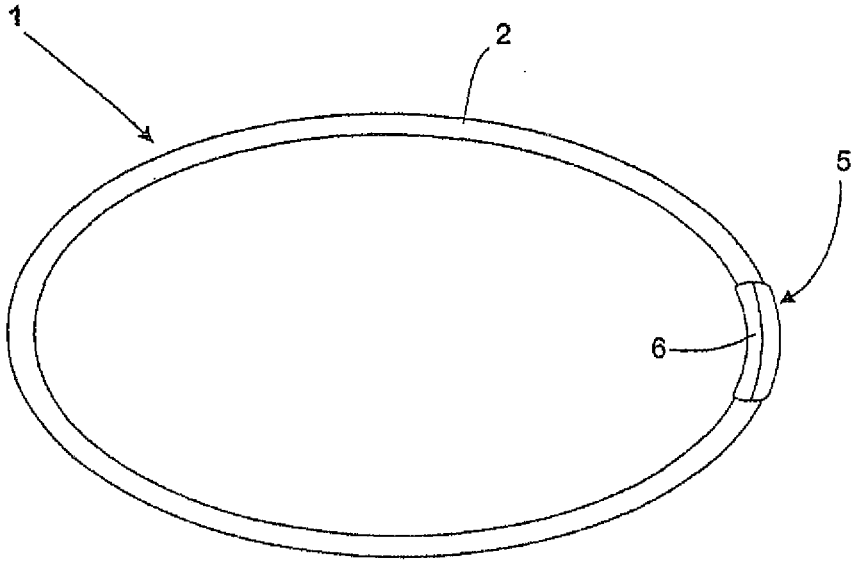
FIG. 1 is a plan view of a completed roundsling.
Figure 2:
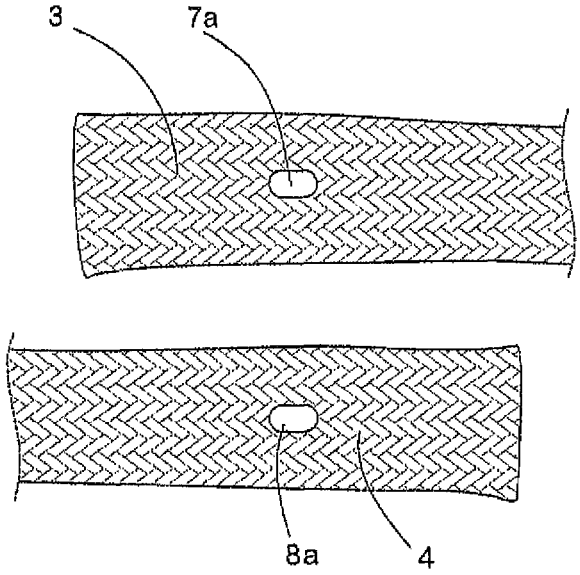
FIG. 2 is a plan view of the end portions of a hollow braided covering for a roundsling which are to be connected together.

The roundsling 1 which is shown in FIG. 1 has a pre-produced tube-like covering 2 which takes the form of a hollow braided structure and whose two end portions 3, 4 are firmly and non-releasably connected together in a connection zone 5. As shown in FIG. 1, the connection zone 5 is surrounded by a protective sleeve 6 in the fully assembled roundsling 1.

In the course of the pre-production process, the braided fabric of the covering 2 is subjected to what is known as "thermofixing" in which sufficient heat is applied to the fabric for its fibres to begin to melt and to bond to one another at their points of intersection. In this way, the braided fabric of the covering 2 forms a solid unit which has high cut resistance and which is protected against loops being pulled out.

Formed in each of the end portions 3, 4 of the covering 2 are two openings 7*a*, 7*b* and 8*a*, 8*b* respectively which are arranged opposite one another and which run in the radial direction from the inner surface 9 of the given end portion 3, 4 to its circumferential surface 10.

To produce the roundsling 1, a strap-like securing member 11 which is formed after the fashion of a strip and which is composed of a strong and flexible textile material is slid through the openings 7*a*, 7*b* in one end portion 3 and is so lined up that its end portions 12, 13 project laterally beyond the end portion 3 for approximately equal lengths.

Figure 3:
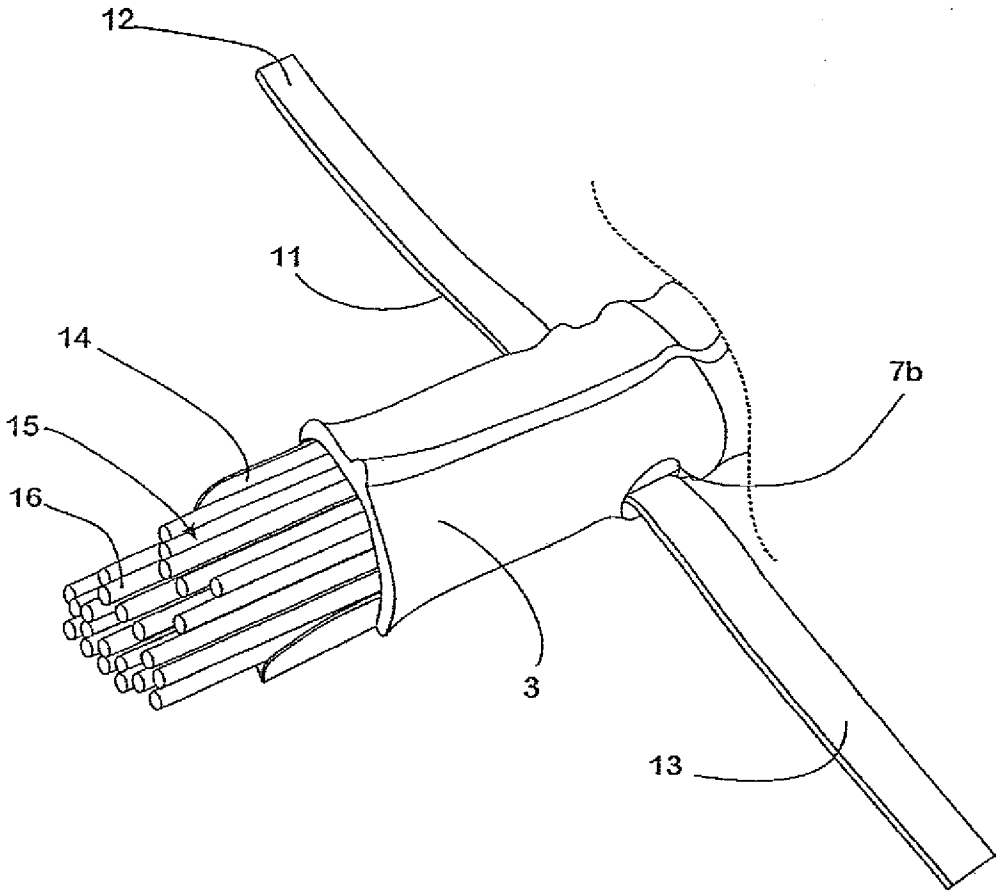
Figure 4:
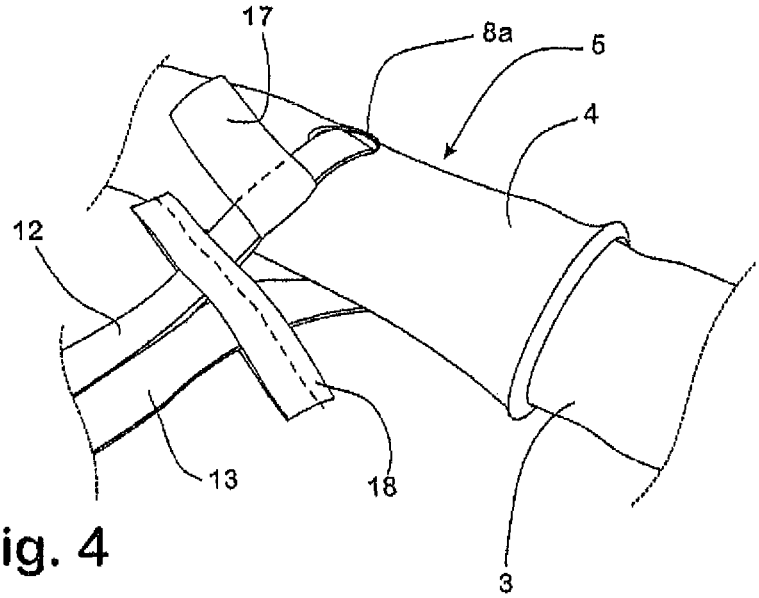
FIG. 4 is a perspective view of the connection zone of the hollow braided covering during a first stage of connection together.

The covering 2 is then slid onto a guiding rail 14 which is U-shaped in cross-section. When this is done, the covering 2, as indicated in FIG. 3, is upset and is so positioned that the securing member 11 is situated between the underside of the guiding rail and the inner surface 9 of the end portion 3. As a result of the sliding on and the upsetting, the inside diameter of the covering increases sufficiently for the fibre strands 16 which together form an inner non-interwoven structure 15 for the roundsling 2 then to be slid into the covering 2 without any problems. When this is done, the guide rail 14 not only holds the covering 2 in a defined position but also ensures that the fibre strands 16 of the inner non-interwoven structure 15 assume their proper position.

Figure 5:
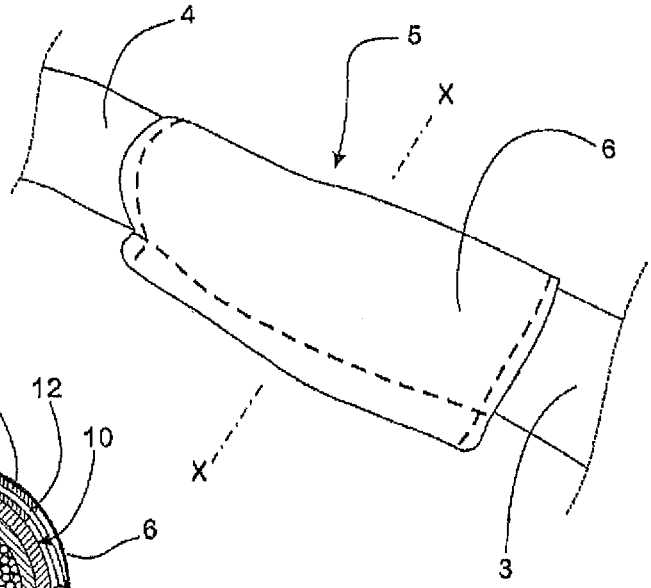
FIG. 5 is a perspective view of the connection zone of the hollow braided covering, when fully connected together.
Figure 6:
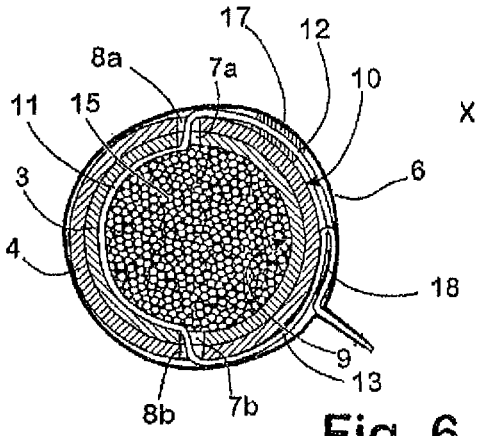
FIG. 6 is a section through the connection zone of the hollow braided covering taken on section line X-X shown in FIG. 5.

Once the inner non-interwoven structure 15 has been fully wound in a manner known per se, the guide rail 14 is withdrawn from the covering 2 and the covering 2 is drawn out to its full length along the inner non-interwoven structure 15 until the end portion 4 rests from outside, in the connection zone 5, on the end portion 3 which is now arranged on the inside. The end portions 3, 4 overlap one another in this case in such a way that their mutually associated openings 7*a*, 8*a*, and 7*b*, 8*b* line up with one another. At the same time, that region of the securing member 11 which is arranged inside that end portion 3 of the covering 2 which end portion 3 is situated on the inside lies between the inner surface 9 of the covering and the inner non-interwoven structure 15 (FIG. 5), and the inner non-interwoven structure 15 is thus able to move without being hampered by the securing member 11.

Respective ones of the end portions 12, 13 of the securing member 11 pass through the mutually associated openings 7*a*, 8*a* and 7*b*, 8*b* in this case.

A means of identification 17 is then threaded onto one end portion 12. The means of identification 17 has for this purpose a supporting layer of tear-resistant material which is trimmed to a strip-like shape and which is folded together to form a loop. Arranged between the ends of the supporting layer which rest against one another is a machine-readable transponder element (not shown), while the relevant end portion 12 of the securing member 11 passes through the opening in the loop formed by the means of identification 17.

That end portion 12 which is provided with the means of identification 17 is then folded around the circumferential surface 10 of the outer end portion 4 until it extends substantially parallel to the other end portion 13 of the securing member 11. That part of the end portion 12 which projects in a free form beyond the means of identification 17 is then sewn to that part of the other end portion 13 of the securing member 11 which is situated next to it by means of a connecting member 18.

The connecting member 18 is formed in this case by two strips composed of a tear-resistant film material which are aligned transversely to the end portions 12, 13 and which extend across these latter. What is achieved in this way is fixing of the securing member 11 in position away from the connection zone 5 without the need for any incursion into the covering for this purpose.

Finally, there is wrapped around the connection zone 5 the protective sleeve 6, which is formed by a trimmed-to-shape piece of a tear-resistant film material whose longitudinal edges are sewn together to position the protective sleeve 6 tightly against the connection zone 5. When this is done, the end portions 12, 13 of the securing member 11 are first so arranged that they lie between the longitudinal edges of the protective sleeve 6 which rest on top of one another, and they are thus held by the sewn seam which connects the longitudinal edges of the protective sleeve 6. The protective sleeve 6 thus not only protects the connection zone 5, the means of identification 17 and the connecting member 18 but also constitutes a further fixing for the securing member 11 which is sewn to it. The sewing of the end portions 12, 13 to the protective sleeve 6 may also take a form such that, with a view to production which is as simple and inexpensive as possible, the separate connecting member 18 can be dispensed if there is found not to be any need in practice for the additional fixing for the securing member 11 which is achieved by means of the connecting member 18.

The invention claimed is:

1. A roundsling for lifting loads, the roundsling comprising an inner non-interwoven structure and a covering which receives the inner non-interwoven structure, the covering taking the form of a hollow braided structure and its end portions being inserted in one another and being connected together to overlap one another in a connection zone, wherein there is formed, in an end portion which is on an outside in the connection zone, at least one lateral opening which leads to a circumferential surface of the end portion which is on the outside in the connection zone, and wherein there is held, in an end portion which is on an inside in the connection zone, a securing member which is passed through an opening in that end portion which is on the outside in the connection zone, wherein the securing member is formed to be of a flexible strip, tape or cable, wherein the securing member is run so as to rest against an inner surface of said end portion which is on the inside in the connection zone and to lie against the inner non-interwoven structure, and wherein at least one end portion of the securing member is passed around the connection zone to another end portion of the securing member, and wherein the end portions of the securing member are firmly and non-releasably connected together.

2. The roundsling according to claim 1, wherein there are present in that end portion which is on the outside in the connection zone at least two openings which are spaced apart from one another in a circumferential direction of the end portion which is on the outside in the connection zone and the securing member is passed through each of these openings.

3. The roundsling according to claim 2, wherein the at least two openings are arranged opposite one another.

4. The roundsling according to claim 2, wherein each of the at least two openings which is present in that end portion which is on the outside in the connection zone has associated with it an opening in that end portion which is on the inside in the connection zone and wherein the securing member is passed through the mutually associated openings in the end portions.

5. The roundsling according to claim 1, wherein the securing member is fixed in position at a point outside of the covering.

6. The roundsling according to claim 1, wherein the end portions of the securing member are sewn together.

7. The roundsling according to claim 1, wherein the end portions of the securing member are connected together by a connecting member.

8. The roundsling according to claim 1, wherein an identification which carries information which clearly identifies the roundsling is fastened to the securing member.

9. The roundsling according to claim 8, wherein the identification is machine-readable.

10. The roundsling according to claim 1, wherein the covering rests firmly and tightly against the inner non-interwoven structure.

11. The roundsling according to claim 1, wherein the inner non-interwoven structure is formed by a wound wire rope or a wound stranded cable.

12. The roundsling according to claim 1, wherein the inner non-interwoven structure is formed by a wound yarn.

13. The roundsling according to claim 1, wherein the connection zone is shielded from its surroundings by a protective sleeve.

* * * * *